US006896707B2

(12) United States Patent
O'Rear et al.

(10) Patent No.: US 6,896,707 B2
(45) Date of Patent: May 24, 2005

(54) METHODS OF ADJUSTING THE WOBBE INDEX OF A FUEL AND COMPOSITIONS THEREOF

(75) Inventors: Dennis J. O'Rear, Petaluma, CA (US); André Peter Steynberg, Vanderbijlpark (ZA); Roger Van Gelder, Beaconsfield (GB)

(73) Assignee: Chevron U.S.A. Inc., San Ramon, CA (US)

( * ) Notice: Subject to any disclaimer, the term of this patent is extended or adjusted under 35 U.S.C. 154(b) by 45 days.

(21) Appl. No.: 10/189,147

(22) Filed: Jul. 2, 2002

(65) Prior Publication Data

US 2004/0013987 A1 Jan. 22, 2004

(51) Int. Cl.[7] ..... C10L 3/00

(52) U.S. Cl. ..... 44/300; 44/457; 585/14; 431/2

(58) Field of Search ..... 44/300, 457; 585/14; 431/2

(56) References Cited

U.S. PATENT DOCUMENTS

| | | | |
|---|---|---|---|
| 4,569,890 | A | 2/1986 | Barthel |
| 4,912,282 | A | 3/1990 | Klaus |
| 5,543,437 | A | 8/1996 | Benham et al. |
| 5,560,900 | A | 10/1996 | Gbordzoe et al. |
| 6,058,761 | A | 5/2000 | Vander Heyden |
| 6,201,029 | B1 | 3/2001 | Waycuilis |
| 6,248,794 | B1 | 6/2001 | Gieskes |
| 6,306,917 | B1 | 10/2001 | Bohn et al. |
| 6,497,750 | B2 | 12/2002 | Butwell et al. |

FOREIGN PATENT DOCUMENTS

| | | | |
|---|---|---|---|
| DE | 19731209 | * | 1/1999 |
| EP | 0 921 184 | A1 | 6/1999 |
| EP | 1 004 746 | A1 | 5/2000 |
| EP | 1 156 026 | A1 | 11/2001 |
| FR | 2809195 | | 11/2001 |
| GB | 976700 | | 10/1965 |
| GB | 1366484 | * | 9/1974 |
| WO | 02/052258 | | 7/2000 |

OTHER PUBLICATIONS

Gerald N. Choi et al., Design/Economics of a Once–Through Natural Gas Fischer–Tropsch Plant with Power Co–Production.

J. Eilers et al., The Shell Middle Distillate Synthesis Process (SMDS), J.C. Baltzer A.G., Scientific Publishing Company, Catalysis Letters 7 (1990) 253–270.

S.T. SIE et al., Conversion of Natural Gas to Transporation Fuels via the Shell Middle Distillate Synthesis Process (SMDS), Catalysis Today, 8 (1991) 371–394, Elsevier Science Publishers B.V.

Choi et al., "Design/Economics of a Natural Gas Based Fischer–Tropsch Plant", Presentation at the A1ChE 1997 Spring National Meeting, Houston, Texas, Mar. 9–13, 1997.

PAJ Abstract vol. No. 017028 M1355 & JP 425112A (Rinnai).

GB Search Report dated Oct. 22, 2003.

* cited by examiner

*Primary Examiner*—Cephia D. Toomer
(74) *Attorney, Agent, or Firm*—Burns, Doane, Swecker & Mathis, L.L.P.

(57) ABSTRACT

Novel methods of providing fuels to a gas-to-liquids facility are disclosed. A gas-to-liquids facility typically operates in a remote location and therefore must supply its own energy needs. These facilities are often sustained by fuels having different heating values, and for smooth operation while transitioning from one fuel to another, (such as during startup, shut down, and emergencies) the Wobble Indices of the two fuels cannot greatly vary from one another. According to embodiments of the present invention, the Wobble Index of either or both of the fuels is adjusted such that their ratio is less than or equal to about 3. The fuel having the higher Wobble Index may be natural gas, and materials such as nitrogen, carbon dioxide and flue gas may be added to lower its Wobble Index. The fuel having the lower Wobble Index may be the tail gas of a Fischer-Tropsch synthesis, and materials such as methane, ethane, LPG, or natural gas may be added to raise its Wobble Index. Alternatively, carbon dioxide may be removed from the tail gas to raise its Wobble Index.

43 Claims, 2 Drawing Sheets

METHODS OF ADJUSTING THE WOBBE INDEX OF A FUEL AND COMPOSITIONS THEREOF

BACKGROUND OF THE INVENTION

1. Field of the Invention

The present invention relates in general to fuels consumed by a gas-to-liquids (GTL) utilities unit. More specifically, the present invention is directed toward methods of adjusting the Wobble Indices of the fuels that provide the energy needs of a gas-to-liquids facility.

2. State of the Art

A gas-to-liquids (GTL) facility converts gaseous hydrocarbons into a wide variety of liquid hydrocarbon products ranging from naphtha to kerosene, diesel, and fuel oils. The starting material for these facilities can be natural gas, a fuel source that comprises predominantly methane, but which may also contain small amounts of higher analogs such as ethane and propane. One method of converting gaseous fuels such as natural gas into liquid fuels is known as the Fischer-Tropsch process. This process utilizes a reaction scheme that was developed in the early 1920s.

In the Fischer-Tropsch process, methane is first converted to a product called syngas, which is a mixture of carbon monoxide and hydrogen. Syngas may also contain components such as water, carbon dioxide, methane, higher hydrocarbons, nitrogen, and argon. The syngas is subsequently converted to the longer chain liquid hydrocarbons mentioned above. In practice, though, the syngas produced at a GTL facility is only partially converted into liquid hydrocarbons; the unconverted portion is commonly referred to as "tail gas." Conventionally, the tail gas is frequently routed to a tubular steam reformer. The tail gas may be used as an energy source for a variety of the utilities needed to operate the GTL facility. These utilities include steam boilers, steam superheaters, electrical power generators, process steam heaters, and the like. Gas powered turbines used for electrical power generation are exemplary of the GTL utilities unit equipment that is very sensitive to changes in the Wobble Indices of its sustaining fuels.

In general, the two most common sources of fuel available to a GTL facility may be the natural gas asset itself, from which the feedstock syngas is produced for Fischer-Tropsch operations, and the tail gas that is a byproduct of those operations. Since natural gas comprises predominantly methane, and since the tail gas includes carbon oxide products that have a low (or zero) heating value, the heating value of the natural gas (and other burning properties such as Wobble Index) is higher than that of the tail gas.

It is advantageous to use tail gas as a source of energy for the GTL facility because to do so allows for a more efficient use of the natural gas resource. In some instances the natural gas asset itself is used for flaring, or otherwise disposing of combustible components, but this is an inefficient use of the resource. For these reasons, tail gas is an excellent choice of a fuel source for sustaining a GTL facility.

However, tail gas is not necessarily available to fuel the facility during certain times of its operation, such as startup, shutdown, and emergencies. During these periods, materials to fuel the facility must be obtained from alternative sources, and frequently the natural gas asset itself is used. Additionally, severe problems can arise if the burners and control systems that are designed to use fuel gas in normal situations are abruptly shifted to a fuel having a much different Wobble Index.

The problems associated with different Wobble Indices may be experienced no matter which direction the change is made; in other words, an increase in the Wobbe Index can be just as disastrous as a decrease in Wobbe Index. For example, if the Wobbe Index of a subsequent fuel is higher than the previous fuel the air supply to the burner may become the limiting factor to combustion, causing the flame temperature to drop and emissions to increase. If the controls are not designed properly, and if the furnace is not being monitored during these events, the rate of consumption of the fuel may actually increase even though a fuel with a higher Wobbe Index is being fed to the burners. The risks inherent with increased fuel consumption include fire and explosion.

On the other hand, if the Wobbe Index of the second fuel is significantly lower than that of the first fuel being consumed, which could happen if the facility switches to tail gas, the air supply to the furnace can exceed that which is required, causing a drop in furnace temperature. In this case the tail gas may then be only partially combusted, resulting in a release of carbon monoxide, and this can pose a serious threat to operators of the facility as well as members of the surrounding community.

One solution to the problem of widely variable Wobbe Indices of different fuels is to provide separate burners and separate fuel distribution lines for each of the types of fuels used by the facility. Alternatively, a burner with multiple burner tips may be employed to facilitate burning multiple fuels with varying Wobbe indices. It will be recognized by those skilled at the art, however, that this would be an expensive solution. It would be much more cost effective to devise methods of controlling or adjusting the Wobbe Index of each of these fuels, including tail gas, natural gas, and syngas, so that only one set of burners, furnaces, control systems, and fuel distribution lines are needed.

What is needed is a method of operating the utilities of a GTL facility such that more than one type of fuel may be used by the same burners and furnaces in the utilities unit. Also needed are methods of treating the fuels that sustain the facility, which may include methods of adjusting the Wobbe Index of the fuels, such that the GTL utilities may operate in a more safe and efficient manner.

SUMMARY OF THE INVENTION

The Fischer-Tropsch process was originally developed as a means to convert coal to mainly automotive fuels and other hydrocarbon products; the process was later adapted to convert natural gas, which is predominantly methane, into liquid hydrocarbon products mainly for use as automotive fuels. For this reason the process is also known as a "gas-to-liquids" (GTL) process. GTL facilities are typically remotely located, and thus are responsible for supplying their own energy needs from an on-site utilities unit.

Two sources of fuel that are commonly used in a GTL utilities unit are natural gas, from which the feedstock syngas is produced for Fischer-Tropsch operations, and a tail gas that is a byproduct of those operations. Since natural gas comprises predominantly methane, and the tail gas includes carbon oxide products that have a low (or zero) heating value, the Wobbe Index of the natural gas is higher than that of the tail gas.

However, tail gas is not necessarily available to fuel the utilities unit during certain periods of operation, such as during startup, shutdown, and emergencies. During these periods, materials to fuel the utilities unit must be obtained from alternative sources, and frequently the natural gas asset itself is used. Additionally, severe problems can arise if the burners and control systems that are designed to use fuel gas in some situations are abruptly shifted to a fuel having a much different Wobbe Index.

The performance of different fuels can be compared using a parameter known as the Wobbe Index. The Wobbe Index (WI) is defined by the following equation:

$$\text{Wobbe Index}=HHV/(SG)^{1/2},$$

where the HHV is the higher heating value of the fuel, also known as the gross heating value, and SG is the specific gravity of the fuel. The HHV can be calculated from standard enthalpies of formation of the fuel's individual components. The equation for the Wobbe Index also takes into account the specific gravity of the fuel, which is related to the quantity of fuel that flows through a burner's orifice at a given supply pressure. The Wobbe Index is designed in such that a way that the operation of a burner and/or furnace is not significantly impacted as the composition of its supply fuel is changed, provided that the Wobbe Index is held substantially constant. There are other factors that may influence burner/furnace operation, one of which is the control of flame speed, but these factors have a relatively minor influence, and the parameters contained in the Wobbe Index are more important by far.

A common situation faced by a gas-to-liquids facility is that during "normal" operating periods the facility is sustained by a fuel having a low Wobbe Index, such as tail gas. At certain times tail gas may not be available, however, such as during start-up, shut-down, and emergencies, and during these periods a different fuel has to sustain the utilities. This fuel may have a higher Wobbe Index than that of the tail gas, which is the case when the natural gas asset itself is used. Ideally, the switch from the low Wobbe Index fuel to the high Wobbe Index fuel (and vice versa) should have a small to negligible impact on the furnaces and burners of the GTL utility. To accomplish this, according to an embodiment of the present invention, the two fuels used before and after the transition have a ratio of their Wobbe Indices of between 0.33 and 3. Thus, the present invention is to a method of combusting a fuel in a utility unit of a GTL facility, the method comprising: (a) providing a first fuel to the utility unit, the first fuel containing natural gas; (b) providing a second fuel to the utility unit, the second fuel containing at least a portion of a tail gas produced by the GTL facility, and (c) adjusting the composition of the first fuel, the second fuel, or both so that the ratio $R_w$ of the Wobbe Index of the first fuel, $W_1$, to that of the second fuel, $W_2$ is between 0.33 and 3.0, wherein the ratio is defined as:

$$R_w=W_1/W_2.$$

In another embodiment, this ratio is between 0.5 and 2. In another embodiment, the ratio is between 0.67 and 1.5.

There are two general approaches one may take to control the Wobbe Index ratio of two fuels. One approach is to decrease the heating value of the fuel with the higher Wobbe Index; the other approach is to increase the Wobbe Index of the fuel with the lower Wobbe index. Of course, a combination of the two approaches may be used. To decrease the Wobbe Index of the natural gas, for example, a lower (or preferably zero) Wobbe Index component is added to create a blend. Options for this component include nitrogen ($N_2$) and carbon dioxide ($CO_2$). Alternatively, the Wobbe Index of the tail gas could have been increased. The latter may be accomplished in one of two ways: 1) by adding a high Wobbe Index component to the tail gas, or 2) by removing a low Wobbe Index component from the tail gas. In one embodiment, the Wobbe Index of the tail gas is increased by mixing a component with a high Wobbe Index into the tail gas to produce a blend. Options for this component include methane, ethane, and liquified petroleum gas (LPG).

DETAILED DESCRIPTION OF THE INVENTION

Figure 1:
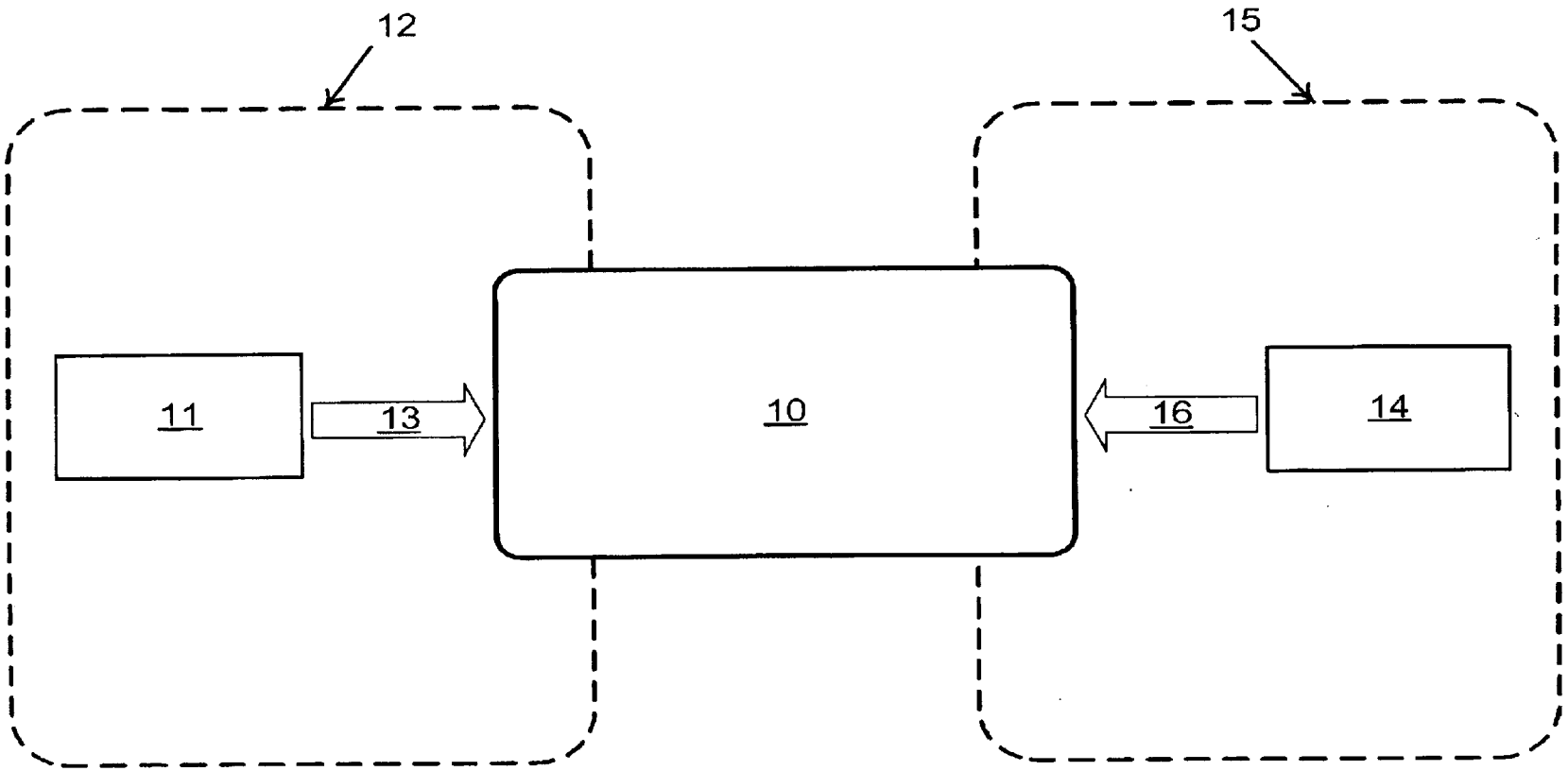
FIG. 1 illustrates an exemplary situation that may be faced by a gas-to-liquids utilities unit, where the utilities are being sustained by two fuels with substantially different Wobbe Indices.

Embodiments of the present invention are directed toward fuels that provide the energy needs of a GTL facility. GTL facilities located in remote sites, which is typically the case, may be responsible for supplying their own energy. The facility's electrical power, heat, and other energy requirements may be produced by equipment as steam boilers, steam superheaters, electrical power generators, process steam heaters, and the like, which may be collectively thought of as the utility unit for the facility. Specifically, embodiments of the present invention are directed toward methods of treating the fuels consumed by a GTL utilities unit if those fuels originate from different sources, and as such have sufficiently different heat contents to be problematic for the utilities plant to run safely and efficiently.

The present description begins with a brief description of a Fischer-Tropsch synthesis process, since this is exemplary of the processes that lie at the heart of a gas-to-liquids facility, followed by a definition of heating value and the Wobbe Index, since this is the property of the fuel that is being adjusted according to embodiments of the present invention.

The Fischer-Tropsch Synthesis

An exemplary GTL facility utilizes a Fischer-Tropsch synthesis process. The precursor material for the process may comprise natural gas. Although natural gas is predominantly methane, it may contain small amounts of ethane and propane as well.

In a typical Fischer-Tropsch process, the natural gas is converted to syngas, which is a mixture of carbon monoxide and hydrogen. The Fischer-Tropsch synthesis process produces olefins, paraffins, and alcohols as Fischer-Tropsch products. The GTL facility will also produce a stream of predominantly unreacted materials, called tail gas. The tail gas may comprise unreacted carbon monoxide and hydrogen, as well as inert species such as nitrogen and argon, water vapor, methane, and small amounts of heavier hydrocarbons, olefins, and oxygenates.

The Fischer-Tropsch process was adapted as a means to convert natural gas into liquid fuels. For this reason the process is also known as a "gas-to-liquids" process. In the GTL process, methane reacts with air (or oxygen, if the air is separated into its constituents) over a first catalyst to create synthesis gas (or syngas), which is a mixture of carbon monoxide and hydrogen. The syngas is then converted into a mixture of liquid hydrocarbons using a second catalyst. The diesel boiling range material that is produced from this synthesis has many beneficial attributes, including a high cetane number, and essentially no sulfur or aromatic content.

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about 300 to 700° F. (149 to 371° C.), preferably about from 400 to 550° F. (204 to 228° C.); pressures of about 10 to 600 psia (0.7 to 41 bars), preferably 30 to 300 psia (2 to 21 bars) and catalyst space velocities of about 100 to 10,000 cc/g/hr., preferably 300 to 3,000 cc/g/hr. The products of a Fischer-Tropsch process may range from $C_1$ to $C_{200+}$, with a majority of the products in the $C_5$–$C_{100+}$ range.

A Fischer-Tropsch synthesis reaction may be conducted in a variety of reactor types including, for example, fixed bed reactors containing one or more catalyst beds, slurry reactors, fluidized bed reactors, or a combination of different type reactors. Such reaction processes and reactors are well known and documented in the literature. A preferred process according to embodiments of the present invention is the slurry Fischer-Tropsch process, which utilizes superior heat and mass transfer techniques to remove heat from the reactor, since the Fischer-Tropsch reaction is highly exothermic. In this manner, it is possible to produce relatively high molecular weight, paraffinic hydrocarbons.

In a slurry process, a syngas comprising a mixture of $H_2$ and CO is bubbled up as a third phase through a slurry formed by dispersing and suspending a particulate Fischer-Tropsch catalyst in a liquid comprising hydrocarbon products of the synthesis reaction. Accordingly, the hydrocarbon products are at least partially in liquid form at the reaction conditions. The mole ratio of the hydrogen to the carbon monoxide may broadly range from about 0.5 to 4, but is more typically within the range of about 0.7 to 2.75, and preferably from about 0.7 to 2.5. A particularly preferred Fischer-Tropsch process is taught in EP 0 609 079, also completely incorporated herein by reference.

Suitable Fischer-Tropsch catalysts comprise one or more Group VIII catalytic metals such as Fe, Ni, Co, Ru, and Re. Additionally, a suitable catalyst may contain a promoter. Thus, a preferred Fischer-Tropsch catalyst comprises effective amounts of cobalt and one or more of the elements Re, Ru, Pt, Fe, Ni, Th, Zr, Hf, U, Mg, and La on a suitable inorganic support material, preferably a material which comprises one or more of the refractory metal oxides. In general, the amount of cobalt present in the catalyst is between about 1 and about 50 percent by weight of the total catalyst composition. The catalysts can also contain basic oxide promoters such as $ThO_2$, $La_2O_3$, MgO, and $TiO_2$, promoters such as $ZrO_2$, noble metals such as Pt, Pd, Ru, Rh, Os, Ir, coinage metals such as Cu, Ag, and Au, and transition metals such as Fe, Mn, Ni, and Re. Support materials including alumina, silica, magnesia and titania or mixtures thereof may also be used. Exemplary catalysts and their preparation may be found, among other places, in U.S. Pat. No. 4,568,663.

Heating Value and the Wobbe Index

A discussion of the technology associated with gas combustion in process heaters has been given in *The John Zinc Combustion Handbook*, C. E. Baukal and R. E. Schwartz., eds. (CRC Press, Boca Raton, 2001), pp. 434–444. This reference teaches how to use a parameter known as the Wobbe Index to match the performance of different fuels, specifically fuels with different heating values. The Wobbe Index (WI) is defined by the following equation:

$$\text{Wobbe Index}=HHV/(SG)^{1/2},$$

where the HHV is the higher heating value of the fuel, also known as the gross heating value, and SG is the specific gravity of the fuel. The specific gravity is the ratio of the molecular weight of the fuel to the molecular weight of air, the latter having a value of about 29.92 grams/mole. The heating value of a fuel may also be referred to as the energy content of the fuel (i.e. heat released when a given quantity of fuel is burned under specific conditions), and the heat released as the fuel is burned is known as the heat of combustion. One set of units for which the heating value of a fuel may be expressed is Btu (British thermal units) per pound or per gallon at 60° F.; in SI units the heat of combustion is kilojoules per kilogram or per cubic meter at 15° C. When the Wobbe Index of a mixture of components is to be calculated, it is important to use the appropriate blending equations. For example, when the Wobbe Index of a mixture of gases is desired, it is preferable to express heating value in units of energy/volume, or energy per mole. The examples shown below use units of Btu/scf, where "scf" is standard cubic feet.

In addition to the higher heating value (HHV), alluded to earlier in the equation for the Wobbe Index is the lower heating value (LHV), also known as the net heating value. The higher heating value is greater because it assumes that water vapor produced by the combustion of a fuel is fully recondensed to the liquid state, whereas the lower heating value assumes that the water vapor product of the combustion remains in the gaseous state. For some situations the lower heating value is the appropriate parameter for comparing fuels, since engines typically exhaust water as a vapor, but it will be noted that the Wobbe Index calculation utilizes the higher heating value parameter.

Both the HHV and LHV may be calculated from standard enthalpies of formation of the fuels components. These are tabulated in a variety of references, including, for example, one by Smith and Van Ness in *Introduction to Chemical Enigineering Thermodynamics*, 2nd Ed., pp. 141–147. The HHV of various compounds typically found in tail gas and potential blend streams are given in the following table:

TABLE I

Thermal properties of typical fuel components

| Component | Formula | HHV (Btu/scf) | Molecular Weight |
|---|---|---|---|
| Hydrogen | $H_2$ | 323.9 | 2 |
| Methane | $CH_4$ | 1009.7 | 16 |
| Ethane | $C_2H_6$ | 1768.8 | 30 |
| Propane | $C_3H_8$ | 2517.3 | 44 |
| i-Butane | $C_4H_{10}$ | 3252.8 | 58 |
| n-Butane | $C_4H_{10}$ | 3232.2 | 58 |
| i-Pentane | $C_5H_{12}$ | 3984.4 | 72 |
| n-Pentane | $C_5H_{12}$ | 4008.4 | 72 |
| Ethylene | $C_2H_4$ | 1599.6 | 28 |
| Propylene | $C_3H_6$ | 2333.8 | 44 |
| 1-Butene | $C_4H_8$ | 3081.3 | 56 |
| 1-Pentene | $C_5H_{10}$ | 3827.1 | 70 |
| Carbon Monoxide | CO | 320.6 | 28 |
| Carbon Dioxide | $CO_2$ | 0 | 44 |
| Nitrogen | $N_2$ | 0 | 28 |
| Argon | Ar | 0 | 40 |

Using the HHV's of the gaseous components listed in Table I, the Wobbe Index may be calculated for several types of fuels typically used to provide energy to a gas-to-liquids facility. Two exemplary fuels for which a Wobbe Index has been calculated are 1) natural gas, and 2) the tail gas from a Fischer-Tropsch synthesis process. These results are shown in the following table:

TABLE II

Properties of exemplary fuels consumed by a GTL utilities plant

| Component/Property Composition (mole %) | Tail gas | Natural gas | LPG |
|---|---|---|---|
| Hydrogen | 25 | 0 | 0 |
| Methane | 10 | 90 | 0 |
| Ethane | 0 | 9 | 0 |
| Propane | 1 | 1 | 50 |
| i-Butane | 0 | 0 | 20 |
| n-Butane | 0 | 0 | 20 |
| i-Pentane | 0 | 0 | 10 |
| n-Pentane | 0 | 0 | 0 |
| Ethylene | 0 | 0 | 0 |
| Propylene | 2 | 0 | 0 |
| 1-Butene | 0 | 0 | 0 |
| 1-Pentene | 0 | 0 | 0 |
| Carbon Monoxide | 25 | 0 | 0 |
| Carbon Dioxide | 35 | 0 | 0 |
| Nitrogen | 2 | 0 | 0 |
| Argon | 0 | 0 | 0 |
| Higher Heating Value | 334 | 1093 | 2954 |
| Molecular Weight | 26.38 | 17.54 | 52.40 |
| Specific Gravity | 0.8817 | 0.5862 | 1.7513 |
| Wobbe Index | 355 | 1427 | 2232 |

It is also desirable to have the dew point of each of the fuels less than the ambient temperature, since it is undesirable to have the fuels forming liquids in the delivery system. In other words, the fuels should be gases, and/or in a vapor state.

Ratios of the Wobbe Index for Two Different Fuels

FIG. 1 illustrates an exemplary situation that may be faced by a gas-to-liquids utilities unit. The GTL utilities unit 10 may be sustained during normal operating periods by a fuel 11 having a low Wobbe Index, where the "normal operating period" is shown generally at 12 in FIG. 1. The arrow at 13 is meant to indicate the controls, monitoring procedures, and fuel combustion conditions that are in place during normal operating periods 12 in order for the GTL utilities 10 to be sustained by the low Wobbe Index fuel 11. In this exemplary embodiment, the low Wobbe Index fuel 11 may comprise the tail gas from a Fischer-Tropsch synthesis process. The utilities unit 10 converts fuel into steam, electricity, process heat, and mechanical energy for the GTL facility.

There may be times, however, when the Fischer-Tropsch tail gas is not available, and during these periods a different fuel may be used to sustain the utilities 10. This fuel may have a different Wobbe Index than that of the low Wobbe Index fuel 11, and in many cases, the Wobbe Index of the fuel used when tail gas is not available is higher than the Wobbe Index of the fuel 11 used during normal operations. One fuel that is readily available to replace tail gas is the natural gas asset itself. This is shown schematically in FIG. 1 where a high Wobbe Index fuel 14 is used during start-up, shut-down, emergencies, and other periods of time shown schematically at 15 when tail gas is not available. In an exemplary embodiment, the high Wobbe Index fuel 14 comprises the natural gas asset itself, which is used to produce the syngas feedstock for the Fischer-Tropsch synthesis. Similar to the arrow 13 for the normal operating period 12, the arrow at 16 is meant to indicate the controls, monitoring procedures, and fuel combustion conditions that are in place during periods 15 when tail gas is not available to the GTL utilities 10, such that the utilities unit is instead sustained by the high Wobbe Index fuel 14.

Ideally, the switch from the low Wobbe Index fuel 11 to the high Wobbe Index fuel 14 (and vice versa) is substantially "seamless," meaning that the transition has a small to negligible impact on the furnaces and burners of the GTL utilities unit 10. The two factors that are most important in determining the ease of the transition are, not surprisingly, the energy content of the fuel (as measured by the HHV), and the amount of fuel gas that will flow through a control valve or an orifice at a given setting. The latter factor is determined by the viscosity of the fuel, which in turn can be related to the square root of the specific gravity of the fuel. The Wobbe Index takes both of these factors into account.

According to one embodiment of the present invention, the transition between the two fuels 11 and 14 will have an acceptable, seamless, mild, small or negligible impact on the GTL utilities 10 and the processes they are carrying out when the ratio of the Wobbe Index of the high Wobbe Index fuel 14 to that of the low Wobbe Index fuel 11 is less than or equal to about 3. In another embodiment, the ratio of the Wobbe Index of fuel 14 to fuel 11 is between 0.5 and 2. In another embodiment, the ratio of the Wobbe Index of fuel 14 to fuel 11 is between 0.67 and 1.5.

Adjusting Wobbe Index to Lower the Wobbe Index Ratio of Two Fuels

It will be noted by those skilled in the art that the ratio of the Wobbe Index of the exemplary natural gas fuel (which is shown as having a Wobbe Index of 1427 in Table II) to the Wobbe Index of the exemplary tail gas fuel (with a Wobbe Index of 355) is greater than about 4. This ratio is in excess of the desired ratio of 3 or less, and a gas-to-liquids utility unit may develop process instabilities if its fuel supply were to be abruptly changed from natural gas to tail gas, and vice versa. It is therefore advantageous to adjust the Wobbe Index of either or both of these fuels so that sudden and/or abrupt changes between these two types of fuels can be tolerated. While modern facilities will have devices to analyze fuel compositions to make adjustments and changes responding, for example, to fluctuations in fuel supply pressures, these devices cannot make large or fast shifts. Thus, control of Wobbe Index is needed even with analytical and mechanical control devices are in place.

There are two general approaches one may take to control the Wobbe Index ratio of two fuels. One approach is to decrease the Wobbe Index of the fuel with the higher Wobbe Index; the other approach is to increase the Wobbe Index of the fuel with the lower Wobbe index. These principles are illustrated schematically in FIG. 2.

Figure 2:
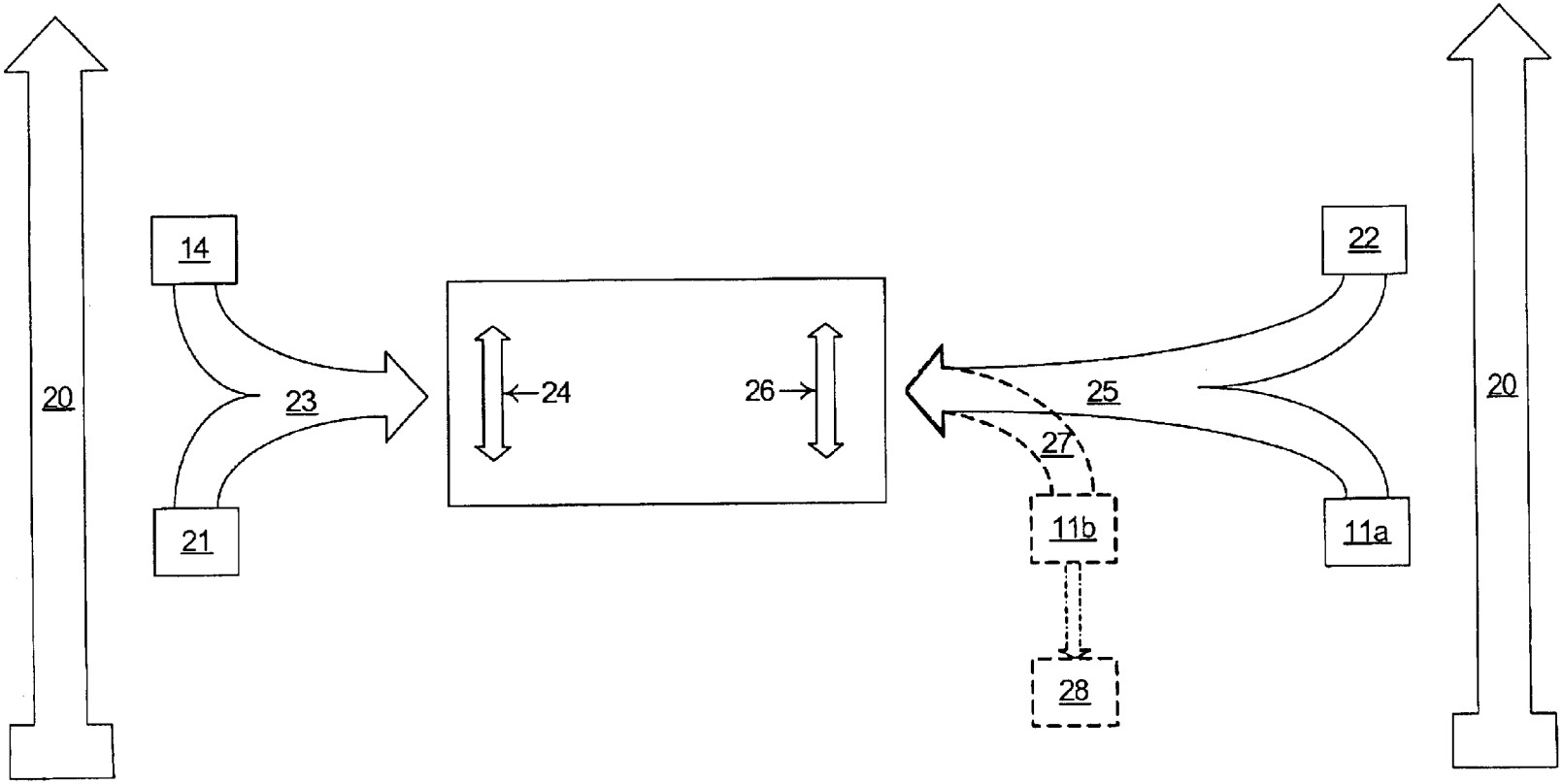
FIG. 2 illustrates two general approaches that may be taken to adjust the Wobbe Index-ratio of two fuels, where in one approach the Wobbe Index of the fuel with the higher Wobbe Index is decreased, and in the other approach the Wobbe Index of the fuel with the lower Wobbe Index is increased.

Referring to FIG. 2, a high Wobbe Index fuel 14 and a low Wobbe Index fuel 11*a* (or 11*b*) are supplying the fuel needs of a GTL utilities unit (not shown in FIG. 2). Again, it will be noted that an exemplary high Wobbe Index fuel 14 is natural gas, and an exemplary low Wobbe Index fuel 11*a* is the tail gas from a Fischer-Tropsch synthesis process. The vertical position of a component or fuel in the schematic layout of FIG. 2 is meant to indicate its relative heating value, as shown qualitatively by the Wobbe Index scale 20. It will be apparent to those skilled in the art that the ratio of the Wobbe Index of the high Wobbe Index fuel 14 to that of the low Wobbe Index fuel 11*a* may be brought into the desired range of 3 or less either by blending a low (or zero) Wobbe Index component 21 into the high Wobbe Index fuel 14, or by blending a material with a high Wobbe Index 22 into the low Wobbe Index fuel 11*a*, including combinations thereof.

The blending of two gas streams to control Wobbe Index is known in the industry. Various devices can be used to assure that the gas streams are mixed, and the resulting properties of the gas stream can be analyzed by on-line calorimeters, gas density devices, or gas chromatographs.

These principles will now be described in greater detail. To decrease the Wobbe Index of the high Wobbe Index fuel 14, a component 21 having a lower (or preferably zero) Wobbe Index is added to achieve a blend 23. The Wobbe Index of the blend 23 falls within a desired range of Wobbe Indices shown graphically by the reference numeral 24. Options for this component 21 include nitrogen ($N_2$), carbon dioxide ($C0_2$), and flue gas. In some embodiments nitrogen is the preferred choice because it is usually available at a GTL facility as a byproduct of the operation that separates air into its component parts to provide oxygen for the manufacture of the syngas. It is also advantageous to use nitrogen as the component 21 because the air separation unit is one of the first to start up at a GTL facility, and so a nitrogen source is typically available before any of the other choices for low Wobbe Index blending components.

The procedure described above achieves the desired goal of decreasing the Wobbe Index of the high Wobbe Index fuel 14; alternatively, the Wobbe Index of the low Wobbe Index fuel 11*a* (or 11*b*) could have been increased. The latter may be accomplished in one of two ways: 1) by adding a high heating value component to the tail gas, or 2) by removing a low heating value component from the tail gas. In one embodiment, the Wobbe Index of the low Wobbe Index fuel 11*a* is increased by mixing a component 22 with a high Wobbe Index into the low Wobbe Index fuel 11*a* to produce a blend 25, and the blend 25 has a Wobbe Index that falls within a desired range 26. Note that the range 26 does not have to be the same as range 24. In other words, the upper limit of the range 26 could be either higher or lower than the upper limit of the range 24, and the lower limit of the range 26 could be either higher or lower than the lower limit of the range 24.

Options for this component 22 include methane, ethane, liquified petroleum gas (LPG) or other hydrocarbons that may be derived from natural gas or other product or feed streams from the GTL facility.

A particularly desirable component to blend with the low Wobbe Index fuel 11*a* is a mixture of propane and butane, commonly referred to as LPG (and also referred to a "broad fraction" in the oil production industry). As shown in Table II, LPG has an even higher Wobbe Index than natural gas, and this makes it particularly suitable as a blending agent. An additional advantage of using LPG is that its export from a GTL facility (or the parent natural gas field) is often difficult and expensive because the LPG first has to be compressed and liquefied, and subsequent transport may require the use of special ocean-going vessels. Furthermore, the market for mixtures of propane and butane is small. To increase the commercial value of this product, it is typically separated into its individual hydrocarbon components propane and butane, each having sufficient purity to meet the specifications for sale. The separations process can be complicated and expensive, with the result that the value of the LPG is often small. Thus, an alternative use for the LPG at the site of production is clearly advantageous, and any material which can be used to adjust heating values is material that does not have to be separated and exported.

In an alternative embodiment, carbon dioxide ($CO_2$) may be removed from the low Wobbe Index fuel 11*b* to increase its Wobbe Index. This fuel may have a composition 27 after the carbon dioxide 28 has been removed. In this embodiment it may be necessary to remove only a portion of the tail gas carbon dioxide content because carbon dioxide 28 has a heating value of zero. Removal of carbon dioxide from gas streams is well known to those skilled in the art and may make use of such technologies as amine and caustic scrubbing. The carbon dioxide containing tail gas is contacted with an alkaline solution into which at least part of the carbon dioxide is absorbed. The carbon dioxide in the alkaline solution is removed by either heating the solution (a technique called temperature swing adsorption) or by reducing its pressure (a technique called pressure swing adsorption). Preferably amines are not used in the alkaline solution, but inorganic caustic components such as sodium hydroxide, potassium hydroxide and combinations are used. This avoids problems associated with the use of expensive amines and their decomposition. Commercial processes which use these inorganic caustic compounds are known as the Benfield process, the Catacarb process, and the Giammarco-Vetrocoke process. These process are described in *Kirk-Othmer Encyclopedia of Chemical Technology*, 4th Edition, Volume 5, pp. 42–46, and references contained therein. Various membranes are also known in the art for partial removal of carbon dioxide from gas streams.

Referring again to FIG. 2, it will be obvious to those skilled in the art that the Wobbe Index of the low Wobbe Index fuel 11*a* (or 11*b*) may be increased simultaneously by both techniques; in other words, a high Wobbe Index material 22 may be added at the same time that carbon dioxide 28 is removed to achieve the desired Wobbe Index range 26.

The carbon dioxide 28 that is removed may be disposed of by a number of options including by pumping it either into the ground or the sea. Injecting it into an underground reservoir (or the ocean) reduces $CO_2$ emissions into the atmosphere. Alternatively, the recovered $CO_2$ may be recycled to the syngas generator for the purpose of controlling the ratio of $H_2$ to CO in that operation. Another method of "disposal" is to mix it with the high Wobbe Index fuel 24 (which may comprise natural gas), as discussed above, and combinations of any of the techniques mentioned above are possible.

The components 21, 22 that are used to adjust Wobbe Index may be stored at the GTL facility so that they are available in the event of a disruption in their supply. Various types of storage systems may be used. For example, $N_2$ can be stored in the liquid state (as liquefied $N_2$), and converted to gaseous $N_2$ for producing the blend 23 as needed. Likewise, $CO_2$ may also be maintained in a compressed gaseous or liquefied state until it is needed. Equipment to store gases in a compressed and/or liquefied state is well known in the industry and available at a GTL facility.

The compression, liquefaction, and gasification operations needed to store and then deliver the blending components ($N_2$, LPG, $CO_2$) requires energy. But the GTL process produces abundant energy in the form of steam, electricity, and high pressure gasses (from which energy can be extracted by decompression). Any and all of these sources can be used to provide the energy needed to process the blending components.

Compositions

A fuel blend composition may be designed in accordance with the principles outlined above, wherein the fuel blend composition is useful for providing energy to a GTL utilities unit. According to one embodiment of the present intention, the fuel blend comprises a first component containing natural gas, and a second component containing at least a portion of the syngas that may be derived from the GTL process itself. Examples of the second component are nitrogen, carbon dioxide, and mixtures thereof. In this embodiment the Wobbe Index of the fuel blend is less about 1,000, which offers the advantages of a less abrupt transition to another fuel blend.

In a related embodiment, where the first component still contains natural gas and the second component is derived from the GTL process and may comprise nitrogen or carbon dioxide, the fuel blend comprises greater than about 21 percent by volume of the second component. Alternatively, the fuel blend may comprise greater than about 42 percent by volume of the second component, and in this case the Wobbe index of the fuel blend is less than about 625. In yet another related embodiment the fuel blend may comprise greater than about 57 percent by volume of the second component, and this case the Wobbe index of the fuel blend is less than about 450.

In a GTL process for producing liquid hydrocarbons from a synthesis gas, the process may have a startup phase followed by a lined-out operation phase. For this situation, the fuel blend compositions described in the preceding two paragraphs would offer advantages to the facility if used during the startup phase of the GTL process.

Alternatively, there are fuel blend compositions that offer advantages if used during the operational phase of the GTL process. An exemplary fuel blend composition that suits this purpose may comprise a tail gas recovered from a GTL process, and a hydrocarbon stream comprising hydrocarbons heavier than methane. For this case, it is appropriate to design the fuel blend composition such that the Wobbe Index of the fuel blend is greater than about 480. The hydrocarbon stream that is added to the tail gas may comprise LPG (mixtures of propane and butane, also known as the "broad fraction"), and in one embodiment the fuel blend comprises greater than about five percent by volume LPG. In a related embodiment the fuel blend may comprise greater than about 15 percent by volume LPG, and in this case the Wobbe Index of the fuel blend is greater than about 720. The fuel blend may comprise greater than about 25 percent by volume LPG, and in this case the Wobbe Index of the fuel blend is greater than about 900.

For those situations where the Wobbe Index of the fuel blend is increased by removing materials with the low Wobbe Index (rather than by adding materials with a high Wobbe Index), a fuel blend composition may be designed wherein the fuel blend comprises greater than about 10 percent by volume carbon dioxide. In alternative embodiments the fuel blend may comprise greater than about 20 percent by volume carbon dioxide, or greater than about 30 percent by volume carbon dioxide.

Examples of the various embodiments of the present invention will be presented next.

EXAMPLE 1

This example shows how a natural gas stream can be blended with $N_2$ to provide a blend having a lower Wobbe Index than that of the starting natural gas. Various ratios of $N_2$ to the fuel gas are studied where the properties of the fuel gas are shown in the following table:

TABLE III

| Blends of $N_2$ with fuel gas | | | | | | | |
|---|---|---|---|---|---|---|---|
| % Nitrogen | 10 | 20 | 30 | 40 | 50 | 60 | 70 |
| % Fuel Gas | 90 | 80 | 70 | 60 | 50 | 40 | 30 |
| Hydrogen | 0 | 0 | 0 | 0 | 0 | 0 | 0 |
| Methane | 81 | 72 | 63 | 54 | 45 | 36 | 27 |
| Ethane | 8.1 | 7.2 | 6.3 | 5.4 | 4.5 | 3.6 | 2.7 |
| Propane | 0.9 | 0.8 | 0.7 | 0.6 | 0.5 | 0.4 | 0.3 |
| i-Butane | 0 | 0 | 0 | 0 | 0 | 0 | 0 |
| n-Butane | 0 | 0 | 0 | 0 | 0 | 0 | 0 |
| i-Pentane | 0 | 0 | 0 | 0 | 0 | 0 | 0 |
| n-Pentane | 0 | 0 | 0 | 0 | 0 | 0 | 0 |
| Ethylene | 0 | 0 | 0 | 0 | 0 | 0 | 0 |
| Propylene | 0 | 0 | 0 | 0 | 0 | 0 | 0 |
| 1-Butene | 0 | 0 | 0 | 0 | 0 | 0 | 0 |
| 1-Pentene | 0 | 0 | 0 | 0 | 0 | 0 | 0 |
| Carbon Monoxide | 0 | 0 | 0 | 0 | 0 | 0 | 0 |
| Carbon Dioxide | 0 | 0 | 0 | 0 | 0 | 0 | 0 |
| Nitrogen | 10 | 20 | 30 | 40 | 50 | 60 | 70 |
| Argon | 0 | 0 | 0 | 0 | 0 | 0 | 0 |
| | 100 | 100 | 100 | 100 | 100 | 100 | 100 |
| Higher Heating Value | 983 | 874 | 765 | 656 | 547 | 437 | 328 |
| Molecular Weight | 18.586 | 19.632 | 20.678 | 21.724 | 22.77 | 23.816 | 24.862 |
| Specific Gravity | 0.6212 | 0.6562 | 0.6911 | 0.7261 | 0.7610 | 0.7959 | 0.8309 |
| Wobbe Index | 1248 | 10780 | 920 | 770 | 627 | 490 | 360 |
| Ratio Wobbe Index of Blended Fuel to Tail Gas | 3.510 | 3.035 | 2.588 | 2.164 | 1.762 | 1.378 | 1.012 |

Thus about 21 percent by volume of $N_2$ is needed to be blended with the fuel gas of Table III to achieve the desired ratio of less than 3. Likewise, about 42 percent by volume $N_2$ would be needed for a ratio of 2, and about 57 percent by volume for a ratio of 1.5.

EXAMPLE 2

This example shows how a tail gas can be blended with a broad fraction to provide a higher Wobbe Index.

TABLE IV

| Blends of broad fraction with tail gas | | | | | | | |
|---|---|---|---|---|---|---|---|
| % Broad Fraction | 5 | 10 | 15 | 20 | 25 | 30 | 35 |
| % Tail Gas | 95 | 90 | 85 | 80 | 75 | 70 | 65 |
| Hydrogen | 23.75 | 22.5 | 21.25 | 20 | 18.75 | 17.5 | 16.25 |
| Methane | 9.5 | 9 | 8.5 | 8 | 7.5 | 7 | 6.5 |
| Ethane | 0 | 0 | 0 | 0 | 0 | 0 | 0 |
| Propane | 3.45 | 5.9 | 8.35 | 10.8 | 13.25 | 15.7 | 18.15 |
| i-Butane | 1 | 2 | 3 | 4 | 5 | 6 | 7 |
| n-Butane | 1 | 2 | 3 | 4 | 5 | 6 | 7 |
| i-Pentane | 0.5 | 1 | 1.5 | 2 | 2.5 | 3 | 3.5 |
| n-Pentane | 0 | 0 | 0 | 0 | 0 | 0 | 0 |
| Ethylene | 0 | 0 | 0 | 0 | 0 | 0 | 0 |
| Propylene | 1.9 | 1.8 | 1.7 | 1.6 | 1.5 | 1.4 | 1.3 |
| 1-Butene | 0 | 0 | 0 | 0 | 0 | 0 | 0 |
| 1-Pentene | 0 | 0 | 0 | 0 | 0 | 0 | 0 |
| Carbon Monoxide | 23.75 | 22.5 | 21.25 | 20 | 18.75 | 17.5 | 16.25 |
| Carbon Dioxide | 33.25 | 31.5 | 29.75 | 28 | 26.25 | 24.5 | 22.75 |
| Nitrogen | 1.9 | 1.8 | 1.7 | 1.6 | 1.5 | 1.4 | 1.3 |
| Argon | 0 | 0 | 0 | 0 | 0 | 0 | 0 |
| | 0 | 0 | 0 | 0 | 0 | 0 | 0 |
| | 100 | 100 | 100 | 100 | 100 | 100 | 100 |
| Higher Heating Value | 465 | 596 | 727 | 858 | 989 | 1120 | 1251 |
| Molecular Weight | 27.681 | 28.982 | 30.283 | 31.584 | 32.885 | 34.186 | 35.487 |
| Specific Gravity | 0.9252 | 0.9686 | 1.0121 | 1.0556 | 1.0991 | 1.1426 | 1.1861 |
| Wobbe Index | 483 | 606 | 723 | 835 | 943 | 1048 | 1149 |
| Ratio Wobbe Index of fuel gas to blended tail gas | 2.953 | 2.358 | 1.976 | 1.710 | 1.513 | 1.363 | 1.243 |

Thus, addition of only about 5 percent by volume of the broad fraction to the tail gas is required to raise the Wobbe Index of the tail gas blend to achieve the desired ratio of less than 3. Likewise, about 15 percent by volume of the broad fraction may be blended with tail gas for a ratio of less than 2, and about 26 percent by volume for a ratio of 1.5.

EXAMPLE 3

This example shows how the Wobbe Index of a tail gas can be increased by the removal of part or all of its $CO_2$ content.

TABLE V

| Removal of $CO_2$ from the Tail Gas | | | | | | |
|---|---|---|---|---|---|---|
| Resulting gas | % $CO_2$ removed | | | | | |
| composition | 50 | 60 | 70 | 80 | 90 | 100 |
| Hydrogen | 30.3 | 31.6 | 33.1 | 34.7 | 36.5 | 38.5 |
| Methane | 12.1 | 12.7 | 13.2 | 13.9 | 14.6 | 15.4 |
| Ethane | 0.0 | 0.0 | 0.0 | 0.0 | 0.0 | 0.0 |
| Propane | 1.2 | 1.3 | 1.3 | 1.4 | 1.5 | 1.5 |
| i-Butane | 0.0 | 0.0 | 0.0 | 0.0 | 0.0 | 0.0 |
| n-Butane | 0.0 | 0.0 | 0.0 | 0.0 | 0.0 | 0.0 |
| i-Pentane | 0.0 | 0.0 | 0.0 | 0.0 | 0.0 | 0.0 |
| n-Pentane | 0.0 | 0.0 | 0.0 | 0.0 | 0.0 | 0.0 |
| Ethylene | 0.0 | 0.0 | 0.0 | 0.0 | 0.0 | 0.0 |
| Propylene | 2.4 | 2.5 | 2.6 | 2.8 | 2.9 | 3.1 |
| 1-Butene | 0.0 | 0.0 | 0.0 | 0.0 | 0.0 | 0.0 |
| 1-Pentene | 0.0 | 0.0 | 0.0 | 0.0 | 0.0 | 0.0 |
| Carbon Monoxide | 30.3 | 31.6 | 33.1 | 34.7 | 36.5 | 38.5 |
| Carbon Dioxide | 21.2 | 17.7 | 13.9 | 9.7 | 5.1 | 0.0 |
| Nitrogen | 2.4 | 2.5 | 2.6 | 2.8 | 2.9 | 3.1 |
| Argon | 0.0 | 0.0 | 0.0 | 0.0 | 0.0 | 0.0 |
| Total | 100 | 100 | 100 | 100 | 100 | 100 |
| Higher Heating Value | 405 | 423 | 442 | 464 | 488 | 514 |
| Molecular Weight | 22.642 | 21.696 | 20.662 | 19.528 | 18.277 | 16.892 |
| Specific Gravity | 0.7568 | 0.7251 | 0.6906 | 0.6527 | 0.6109 | 0.5646 |
| Wobbe Index | 465 | 496 | 532 | 574 | 624 | 684 |
| Ratio Wobbe Index of Fuel Gas to $CO_2$—Depleted Tail Gas | 3.068 | 2.876 | 2.682 | 2.487 | 2.289 | 2.088 |

Removal of slightly more than half of the $CO_2$ is required to adjust the ratio of the Wobbe Index values to below 3, and removal of substantially all of the $CO_2$ is required to achieve a desired ration of about 2. The $CO_2$ recovered from the tail gas could also be used to reduce the Wobbe Index of the natural gas, thus making adjustments in the composition and Wobbe Index values of both streams to bring their relative values below 3.0.

Many modifications of the exemplary embodiments of the invention disclosed above will readily occur to those skilled in the art. Accordingly, the invention is to be construed as including all structure and methods that fall within the scope of the appended claims.

What is claimed is:

1. A method of combusting a fuel in a utility unit of a GTL facility, the method comprising:

(a) providing a first fuel to the utility unit, the first fuel containing natural gas;

(b) providing a second fuel to the utility unit, the second fuel containing at least a portion of a tail gas produced by the GTL facility, and (c) adjusting the composition of the first fuel, the second fuel, or both so that the ratio $R_w$ of the Wobbe Index of the first fuel, $W_1$, to that of the second fuel, $W_2$ is between 0.33 and 3.0, wherein the ratio is defined as:

$$R_w = W_1/W_2.$$

2. The method of claim 1, wherein the ratio is between 0.5 and 2.

3. The method of claim 1, wherein the ratio is between 0.67 and 1.5.

4. The method of claim 1, wherein the adjusting step is carried out by decreasing the Wobbe Index of the first fuel.

5. The method of claim 4, wherein the adjusting step is carried out by blending the first fuel with $N_2$ recovered from an air separation unit associated with the GTL process.

6. The method of claim 4, wherein the adjusting step is carried out by blending the first fuel with a $CO_2$ containing stream recovered from the GTL facility.

7. The method of claim 1, wherein the adjusting step is carried out by increasing the Wobbe Index of the second fuel.

8. The method of claim 7, wherein the adjusting step is carried out by blending LPG with the second fuel.

9. The method of claim 7, wherein the adjusting step is carried out by blending a methane containing gas with the second fuel.

10. The method of claim 7, wherein the adjusting step is carried out by removing at least part of the $CO_2$ contained in the second fuel.

11. The method of claim 10 further comprising disposing of the removed $CO_2$ underground or in the sea.

12. The method of claim 10 further comprising using the removed $CO_2$ to decrease the Wobbe Index of the first fuel.

13. The method of claim 8 wherein at least a portion of the LPG is recovered from the natural gas.

14. The method of claim 1, wherein the utility unit is selected from the group consisting of a steam boiler, a steam superheater, a process stream heater, and an electric power generator.

15. The method of claim 14, wherein the ratio is controlled to a value of between 0.8 and 1.25 for electric power generators.

16. The method of claim 1, wherein the dew point of the first fuel and dew point of the second fuel are less than the ambient temperature.

17. A GTL utilities fuel mixture comprising a first fuel component containing natural gas and a second fuel component containing at least a portion of a tail gas produced by a GTL facility, wherein the ratio $R_w$ of the Wobbe Index of the first fuel component, $W_1$, to that of the second fuel component, $W_2$, is adjusted such that the ratio is between 0.33 and 3, wherein the ratio is defined as:

$$R_w = W_1/W_2.$$

18. A method of sustaining the energy needs of a gas-to-liquids facility, the method comprising:

(a) providing a high Wobbe Index fuel and a low Wobbe Index fuel to the utilities unit of the gas-to-liquids facility, and (b) adjusting the composition of either the high Wobbe Index fuel, the low Wobbe Index fuel, or both, such that the ratio $R_w$ of the Wobbe Indices of the high Wobbe Index fuel, $W_1$, to that of the low Wobbe Index fuel, $W_2$, is between 0.33 and 3, wherein the ratio is defined as:

$$R_w = W_1/W_2.$$

19. The method of claim 18, wherein the ratio is between 0.5 and 2.

20. The method of claim 18, wherein the ratio is between 0.67 and 1.5.

21. The method of claim 18, wherein the gas-to-liquids facility is carrying out a Fischer-Tropsch synthesis process.

22. The method of claim 18, wherein the step that provides the high Wobbe Index fuel to the utilities unit is a step that provides natural gas.

23. The method of claim 18, wherein the step that provides the low Wobbe Index fuel to the utilities unit is a step that provides tail gas from a Fischer-Tropsch process.

24. The method of claim 18, wherein the adjusting step is conducted by blending a material with a low Wobbe Index into the high Wobbe Index fuel.

25. The method of claim 24, wherein the material that is blended into the high Wobbe Index fuel is selected from the group consisting of nitrogen, carbon dioxide, and flue gas.

26. The method of claim 18, wherein the adjusting step is conducted by blending a material with a high Wobbe Index into the low Wobbe Index fuel.

27. The method of claim 26, wherein the material that is blended into the low Wobbe Index fuel is selected from the group consisting of methane, ethane, propane, butane, LPG, higher hydrocarbons, and natural gas.

28. The method of claim 18, wherein the adjusting step is carried out by removing a material having a low Wobbe Index from the low Wobbe Index fuel.

29. The method of claim 28, wherein the material that is removed from the low Wobbe Index fuel is carbon dioxide.

30. The method of claim 18, wherein the step that provides fuels to the utilities unit provides fuels having a dew point above the ambient temperature so that the fuels are in a gaseous state.

31. A fuel blend composition useful for providing energy to a GTL utilities unit, the fuel blend comprising:

(a) a first component of the fuel blend, the first component containing natural gas; and (b) a second component of the fuel blend, the second component comprising a gaseous material selected from the group consisting of nitrogen, carbon dioxide, and mixtures thereof; wherein (i) the second component is derived from a GTL process; and (ii) the Wobbe Index of the fuel blend composition is less than about 1,000.

32. The fuel blend composition of claim 31, wherein the fuel blend comprises greater than about 21 percent by volume of the second component.

33. The fuel blend composition of claim 31, wherein the fuel blend comprises greater than about 42 percent by volume of the second component, and wherein the Wobbe Index of the fuel blend is less than about 625.

34. The fuel blend composition of claim 31, wherein the fuel blend comprises greater than about 57 percent by volume of the second component, and wherein the Wobbe Index of the fuel blend is less than about 450.

35. A GTL process for producing liquid hydrocarbons from a synthesis gas, wherein the process has a startup phase followed by an operational phase, and wherein the startup phase of the GTL process uses the fuel blend composition of claim 31.

36. A fuel blend composition useful for providing energy to a GTL utilities unit, the fuel blend comprising:

(a) a tail gas recovered from a GTL process; and (b) a hydrocarbon stream comprising hydrocarbons heavier than methane; wherein the Wobbe Index of the fuel blend is greater than about 480.

37. The fuel blend composition of claim 36, wherein the fuel blend comprises greater than about five percent by volume LPG.

38. The fuel blend composition of claim 36, wherein the fuel blend comprises greater than about 15 percent by volume LPG, and wherein the Wobbe Index of the fuel blend is greater than about 720.

39. The fuel blend composition of claim 36, wherein the fuel blend comprises greater than about 25 percent by volume LPG, and wherein the Wobbe Index of the fuel blend is greater than about 900.

40. The fuel blend composition of claim 36, wherein the fuel blend comprises greater than about 10 percent by volume carbon dioxide.

41. The fuel blend composition of claim 36, wherein the fuel blend comprises greater than about 20 percent by volume carbon dioxide.

42. The fuel blend composition of claim 36, wherein the fuel blend comprises greater than about 30 percent by volume carbon dioxide.

43. A GTL process for producing liquid hydrocarbons from a synthesis gas, wherein the process has a startup phase followed by an operational phase, and wherein the operational phase of the GTL process uses the fuel blend composition of claim 36.

* * * * *